US010816196B2

(12) United States Patent
Chen

(10) Patent No.: US 10,816,196 B2
(45) Date of Patent: Oct. 27, 2020

(54) COMBUSTION DEVICE WITH HEAT DISSIPATING DESIGN

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 76 days.

(21) Appl. No.: 16/215,743

(22) Filed: Dec. 11, 2018

(65) Prior Publication Data

US 2020/0116352 A1 Apr. 16, 2020

(30) Foreign Application Priority Data

Oct. 11, 2018 (TW) ..... 107135761 A

(51) Int. Cl.
*F23D 99/00* (2010.01)

(52) U.S. Cl.
CPC ..... *F23D 91/00* (2015.07); *F23D 2206/0094* (2013.01)

(58) Field of Classification Search
CPC ..... F23C 7/002; F23C 7/004; F23C 7/006; F23C 7/02; F23D 3/02; F23D 3/04; F23D 3/20
USPC ..... 431/182–184, 331–342, 202, 289–325
See application file for complete search history.

(56) References Cited

U.S. PATENT DOCUMENTS

| | | | | |
|---|---|---|---|---|
| 6,848,901 | B1 | 2/2005 | Matsuyama | |
| 9,163,831 | B2 | 10/2015 | Chen | |
| 9,377,187 | B2 | 6/2016 | Chen | |
| 9,651,246 | B2 | 5/2017 | Chen | |
| 10,119,702 | B2 | 11/2018 | Fendler et al. | |
| 2007/0111149 | A1 | 5/2007 | Matsuyama | |
| 2012/0006316 | A1* | 1/2012 | Shimek | F23L 1/02 126/519 |
| 2015/0167964 | A1* | 6/2015 | Chen | F23D 3/20 431/353 |
| 2019/0101281 | A1 | 4/2019 | Chen | |

FOREIGN PATENT DOCUMENTS

| | | | |
|---|---|---|---|
| DE | 90766 | C | 9/1895 |
| JP | S4214288 | Y1 | 8/1967 |
| JP | S58130904 | A | 8/1983 |
| TW | I625493 | B | 6/2018 |

* cited by examiner

*Primary Examiner* — Vivek K Shirsat
(74) *Attorney, Agent, or Firm* — Alan D. Kamrath; Karin L. Williams; Mayer & Williams PC

(57) ABSTRACT

A combustion device with heat dissipating design includes a burner apparatus and a shield apparatus. The burner apparatus includes a fuel reservoir which has a top defining an opening. The shield apparatus defines a space and the burner apparatus is disposed within the space. The shield apparatus has a bottom and the opening is at a first height in a vertical direction from the bottom. The shield apparatus defines a first through hole extending therethrough and communicating the space and the outside of the shield apparatus and the first through hole is at a second height in the vertical direction from the bottom. The second height is less than the first height.

18 Claims, 7 Drawing Sheets

COMBUSTION DEVICE WITH HEAT DISSIPATING DESIGN

BACKGROUND OF THE INVENTION

1. Field of the Invention

The present invention relates to a combustion device and, particularly, to a combustion device with heat dissipating design.

2. Description of the Related Art

TW Pat. No. 1625493 shows a fire display device. The device includes an accommodation apparatus, a burning apparatus and a fixing apparatus. The accommodation apparatus includes a fuel container, a cover, and a heat insulating member. The fuel container includes an accommodation portion therein and is connected with the cover. A filling hole and a first positioning slot extend through the cover and communicate with the accommodation portion. The heat insulating member is connected with the cover and the heat insulating member and the accommodation portion are disposed at different ends of the cover. A second positioning slot extends through top and bottom sides of the heat insulating member and communicates with the first positioning slot. A second end of the combustion device is inserted into the accommodation portion through the second positioning slot and the first positioning slot. The fixing apparatus includes a first clamping surface and a second clamping surface corresponding to each other and sandwiching the combustion device.

The purpose of the fire display device is to produce a flame that is ornamental and has a stable flame pattern for achieving an expected viewing effect. It is, however, a problem to use the fire display device outdoors as there is no apparatus that can shield the combustion device and prevent the flame from flickering or blowing out in the wind. As a result, the pattern of the flame is not sustained, the flame does not have an expected viewing effect, and the fuel container is likely to be burned by the flame and gets hot.

The flame, especially, burned in a glass container can obtain an optimum viewing effect. The fuel container of the fire display device is made of glass material. Further, in order to obtain a better viewing effect, an ideal way is to increase the height of the fuel container to an extent that allows the glass fuel container to surround the flame. When the flame burns, air surrounding the flame is heated by the flame and flows upward, the loss of the air around the flame creates a low pressure region, the air near the wall of the fuel container flows toward the flame, the low pressure region is created adjacent to the fuel container due to the loss of the air, and only the air that is adjacent to the opening of the fuel container can replenish the fuel container. Nevertheless, the air at the opening of the fuel container has been heated by the flame. Further, the hot air will flow into the fuel container by convection and cause the fuel container to accumulate heat continuously such that the temperature of the fuel container rises and there is not only a risk that a user gets burned, but also a high risk of flash flame when fuel in the fuel container is heated and accumulated. Moreover, the backflow of hot air disturbs the air around the flame and causes excessive flame disturbance and reduces the visibility of the flame. In addition, although the low height of the glass of the fire display device is favorable for heat dissipation, the flame is less shielded from the current of the ambient airflow, and the shape of the flame is not effectively prevented from being affected by the airflow. Further, when the flame is deflected by the wind pressure of the airflow, the surrounding of the container is likely to be heated by the flame. However, if the height of the glass is increased to improve the windproof effect, the phenomenon of hot air recirculation occurs and the accumulation of heat becomes more serious. In particular, when the scale of combustion is increased, the fuel container and the fuel accumulate heat can easily burn a user and cause the fuel to exceed its flash point so that a flash flame risk occurs.

Moreover, there is a drawback for the existing design. If a user overfills fuel accidentally, overfilled fuel may cause risk during burning.

The present invention is, therefore, intended to obviate or at least alleviate the problems encountered in the prior art.

SUMMARY OF THE INVENTION

According to the present invention, a combustion device with heat dissipating design includes a burner apparatus and a shield apparatus. The burner apparatus includes a fuel reservoir which has a top defining an opening. The shield apparatus defines a space and the burner apparatus is disposed within the space. The shield apparatus has a bottom and the opening is at a first height in a vertical direction from the bottom. The shield apparatus defines a first through hole extending therethrough and communicating the space and the outside of the shield apparatus and the first through hole is at a second height in the vertical direction from the bottom. The second height is less than the first height.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
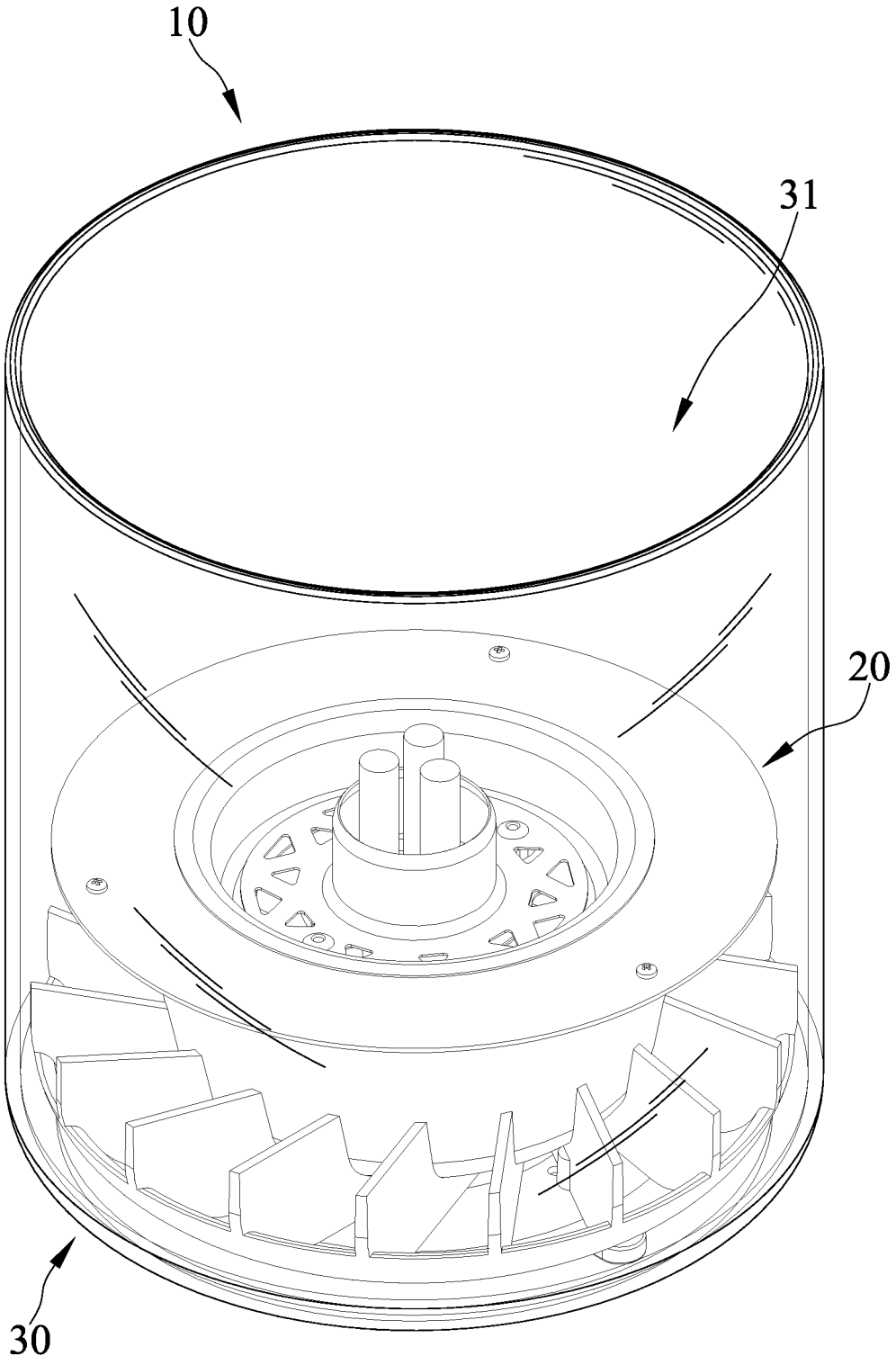
FIG. 1 is a perspective view of a combustion device with heat dissipating design in accordance with a first embodiment of the present invention.
Figure 2:
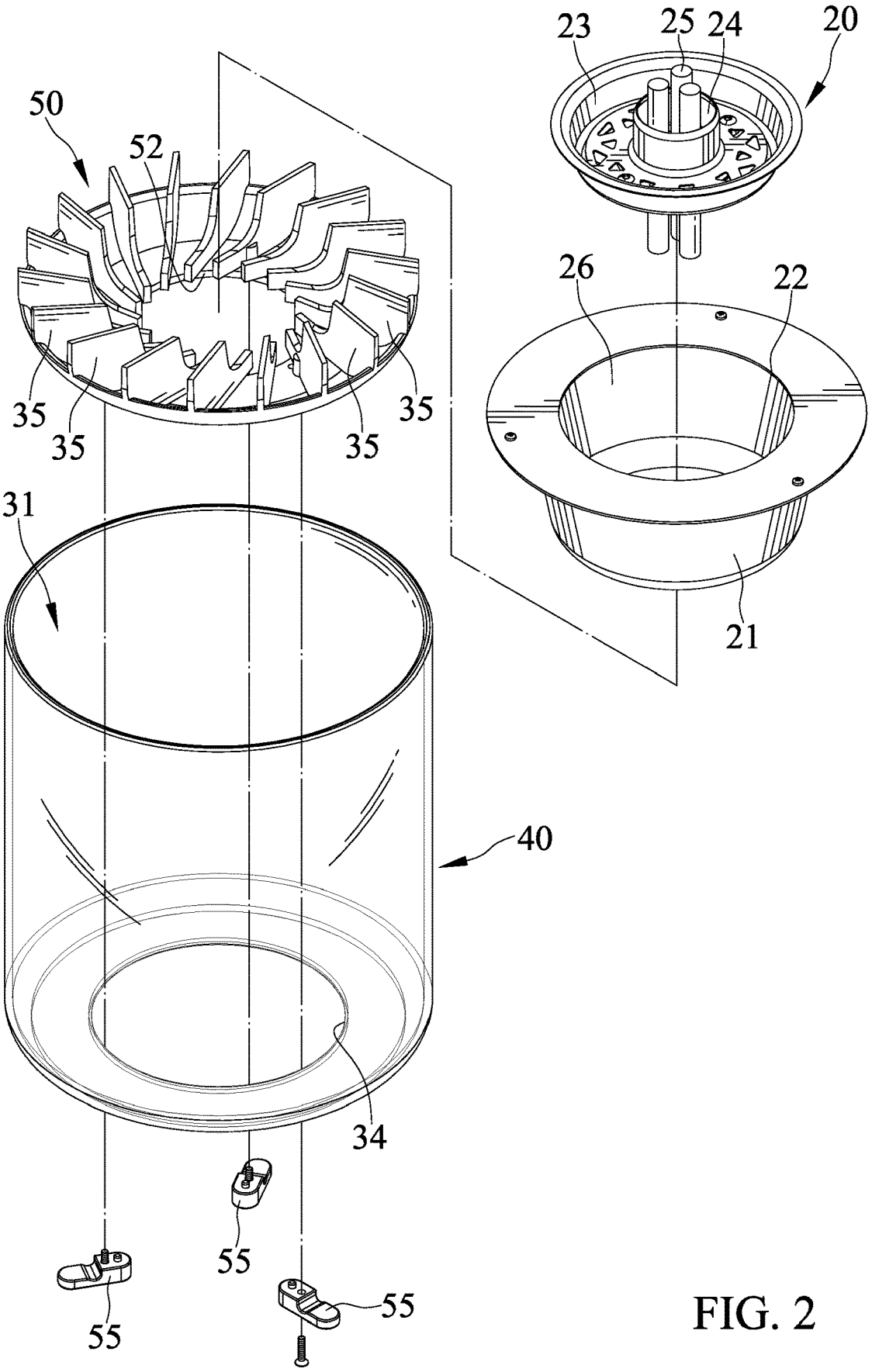
FIG. 2 is an exploded perspective view of the combustion device of FIG. 1.
Figure 3:
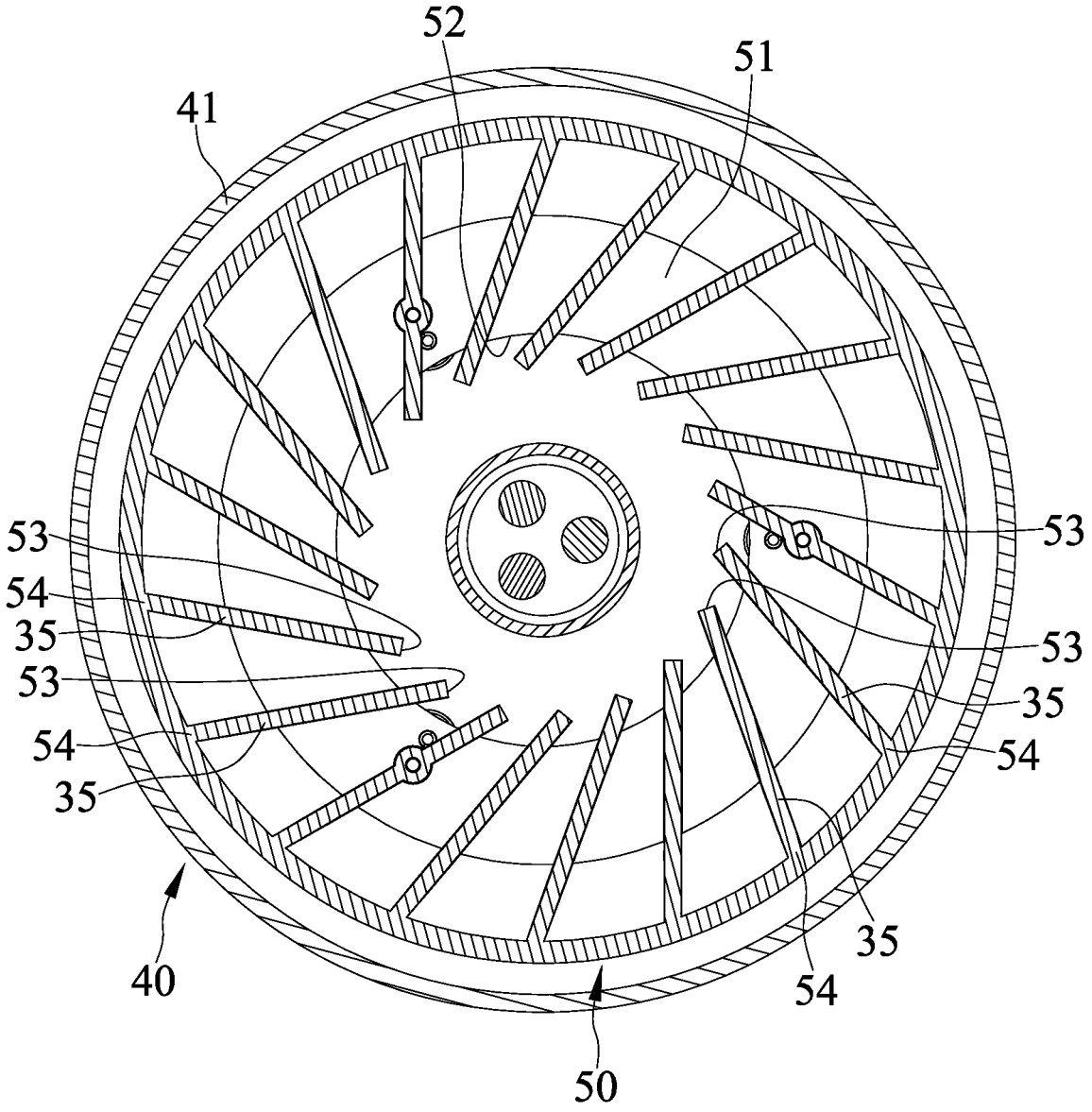
FIG. 3 is a cross-sectional view of the combustion device of FIG. 1.

FIGS. 1 through 5 show a combustion device with heat dissipating design 10 in accordance with a first embodiment of the present invention.

The combustion device 10 includes a burner apparatus 20 and a shield apparatus 30.

The burner apparatus 20 includes a fuel reservoir 21. The fuel reservoir 21 has a top defining an opening 22. The burner apparatus 20 includes a cap 23 disposed above the fuel reservoir 21. The cap 23 has at least one hole 24 extending therethrough and communicating an accommodation portion 26 of the fuel reservoir 21. The cap 23 engages and holds at least one wick 25 in the at least one hole 24. The at least one wick 25 has one end protruding above the cap 23 and another end protruding below the cap 23 and received by the accommodation portion 26. The cap 23 is in a form of a shallow container with a raised rim and has a bottom inserted through the opening 22 and received by the accommodation portion 26.

The shield apparatus 30 defines a space 31 and the burner apparatus 20 is disposed within the space 31. The shield apparatus 30 has a top 33 at a height in the vertical direction from the bottom 32. The shield apparatus 30 has a bottom 32 and the opening 22 is at a first height H1 in a vertical direction from the bottom 32.

The shield apparatus 30 defines a first through hole 34 extending therethrough and communicating the space 31 and the outside of the shield apparatus 30 and the first through hole 34 is at a second height H2 in the vertical direction from the bottom 32. The second height H2 is less than the first height H1. The first through hole 34 drains the overfilled fuel to minimize the fuel overfilled risks.

The shield apparatus 30 includes a plurality of flow guiding blades 35 evenly disposed around the burner apparatus 20 and extending radially. The plurality of flow guiding blades 35 are disposed at a height in the vertical direction between the opening 22 and the first through hole 34. The plurality of flow guiding blades 35 has a bottom side, a top side opposite the bottom side, and two opposite lateral sides extending from the top side to the bottom side. The top sides of the plurality of flow guiding blades 35 bear the fuel reservoir 21. Each of the plurality of flow guiding blades 35 extends radially from a first end 53 to a second end 54. The top surface of each of the plurality of flow guiding blades 35 forms a slope adjacent to the first end. The burner apparatus 20 is disposed adjacent to the first ends of the plurality of flow guiding blades 35 and the fuel reservoir 21 is disposed above the slopes of the plurality of flow guiding blades 35. The two opposite lateral sides of each of the plurality of flow guiding blades 35 extend radially in a straight line.

The shield apparatus 30 includes a cover 40 which is hollow and includes a side wall 41 extending in the vertical direction and a bottom wall 42. The cover 40 is tubular. The cover 40 allows light to pass through. The cover 40 is made of glass. The space 31 is defined by the cover 40. The first through hole 34 extends through the bottom wall 42.

Further, a flow guiding apparatus 50 is disposed within the space 31. The flow guiding apparatus 50 includes a seat 51 and the bottom wall 42 bears the seat 51. The seat 51 defines a second through hole 52 extending therethrough and corresponding with the first through hole 34. The flow guiding apparatus 50 includes at least one foot 55. The at least one foot 55 has a first end connected with bottom wall 42 and disposed outside the cover 40 and a second end configured to stand on a surface on which the combustion device 10 is placed and forming the bottom 32 of the shield apparatus 30.

Furthermore, the plurality of flow guiding blades 35 is integrated with the seat 51. The bottom sides of the plurality of flow guiding blades 35 are connected with the seat 51. The seat 51 has two opposite sides and the bottom wall 42 bears the seat 51 from one of opposite sides and the plurality of flow guiding blades 35 are disposed on the other of opposite sides. The plurality of flow guiding blades 35 and the seat 51 are made in one piece.

Figure 4:
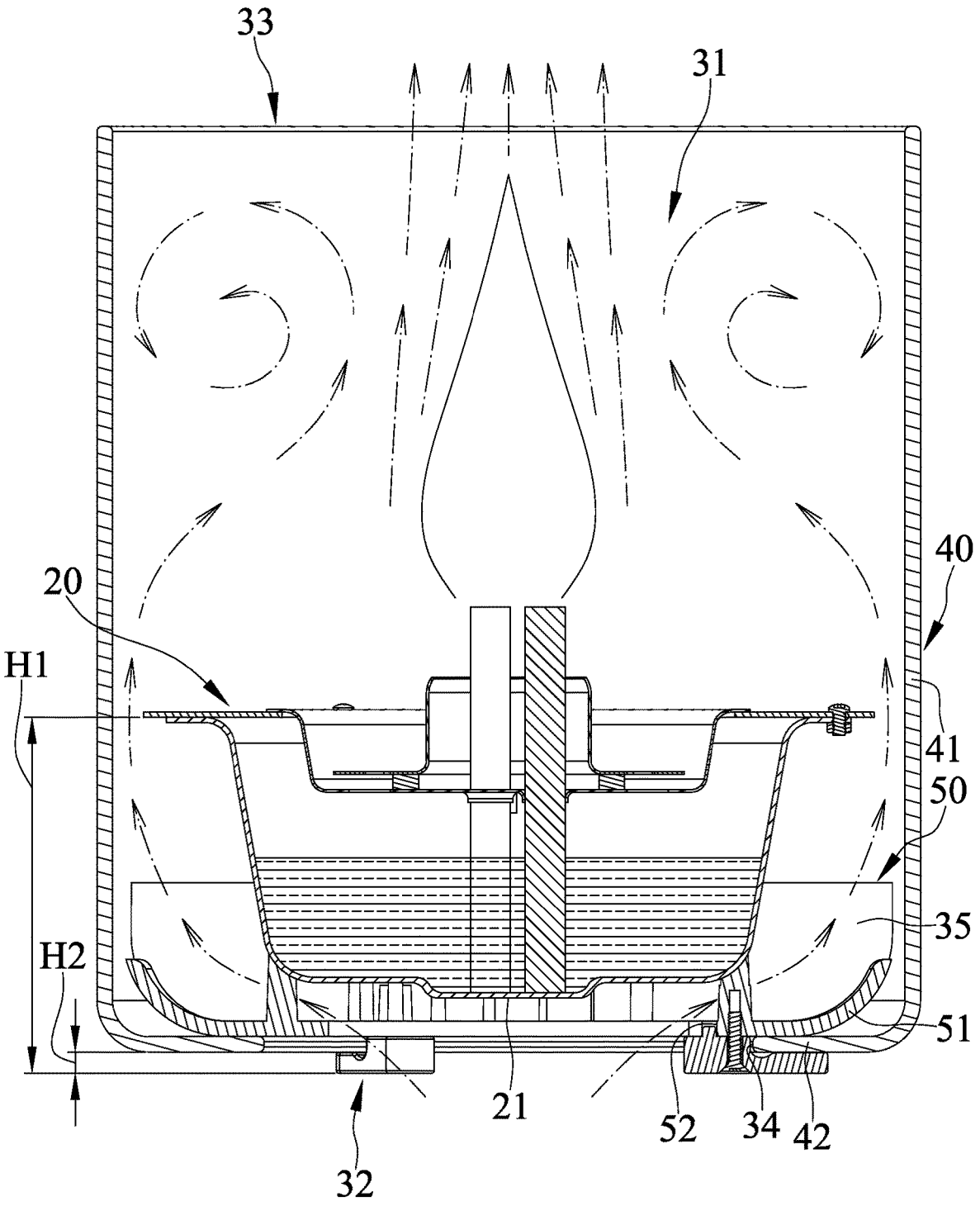
FIG. 4 is a cross-sectional view illustrating the combustion device of FIG. 1 in use and producing a flame, as well as air circulating the combustion device to allow the combustion device to dissipate heat, with arrows indicating the air.

FIG. 4 is a cross-sectional view illustrating the combustion device 10 in use and producing a flame, as well as air circulating the combustion device to allow the combustion device to dissipate heat, with arrows indicating the air.

Figure 5:
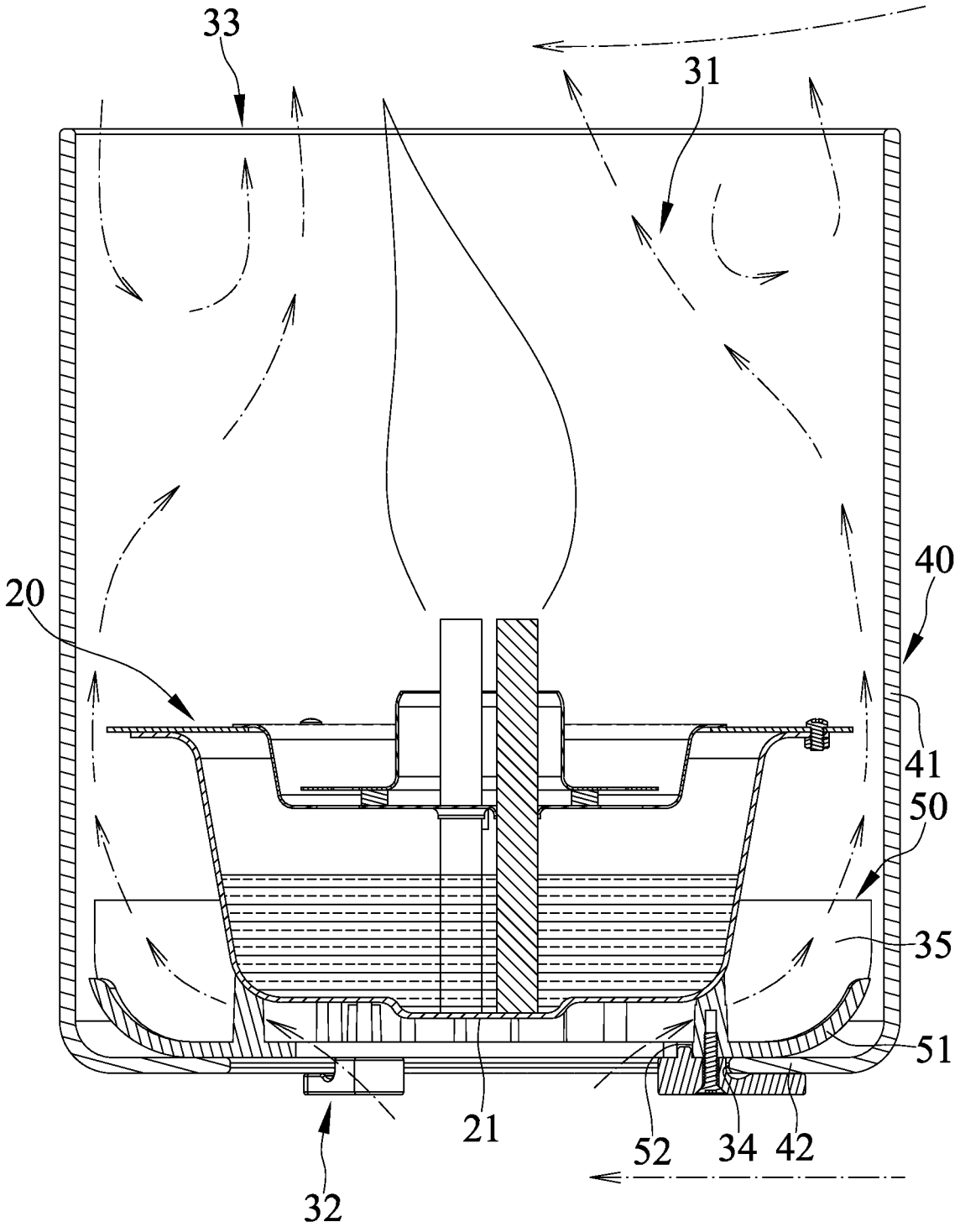
FIG. 5 is a cross-sectional view illustrating the combustion device of FIG. 1 is subject to a side wind.

FIG. 5 is a crosssectional view illustrating the combustion device 10 subject to a side wind. An air recirculation is formed at a recessed area around the combustion device 10 and a portion of the side wind is inevitably blocked by the outer cover 40 and enters the space 31 downward. Since the flow guiding blades 35 can guide and restrict the flow direction of the cooling air, the upward air flow is offset or weakened by the recirculation formed by the circulation of the side wind, and the influence of the side wind on the combustion device 10 can be greatly reduced, so that the high temperature is not directly contacted with the outer cover to reduce the risk of high temperature accumulation. The combustion device 10 can be normally used and maintains flame visibility even in a windy outdoor environment.

Further, when the combustion device 10 is moved, a user can directly take the cover 40, and the flow guiding apparatus 50 and the plurality of feet 55 in the embodiment prevents parts of the combustion device 10 from being left even if the user directly grasps the outer cover 40.

Figure 6:
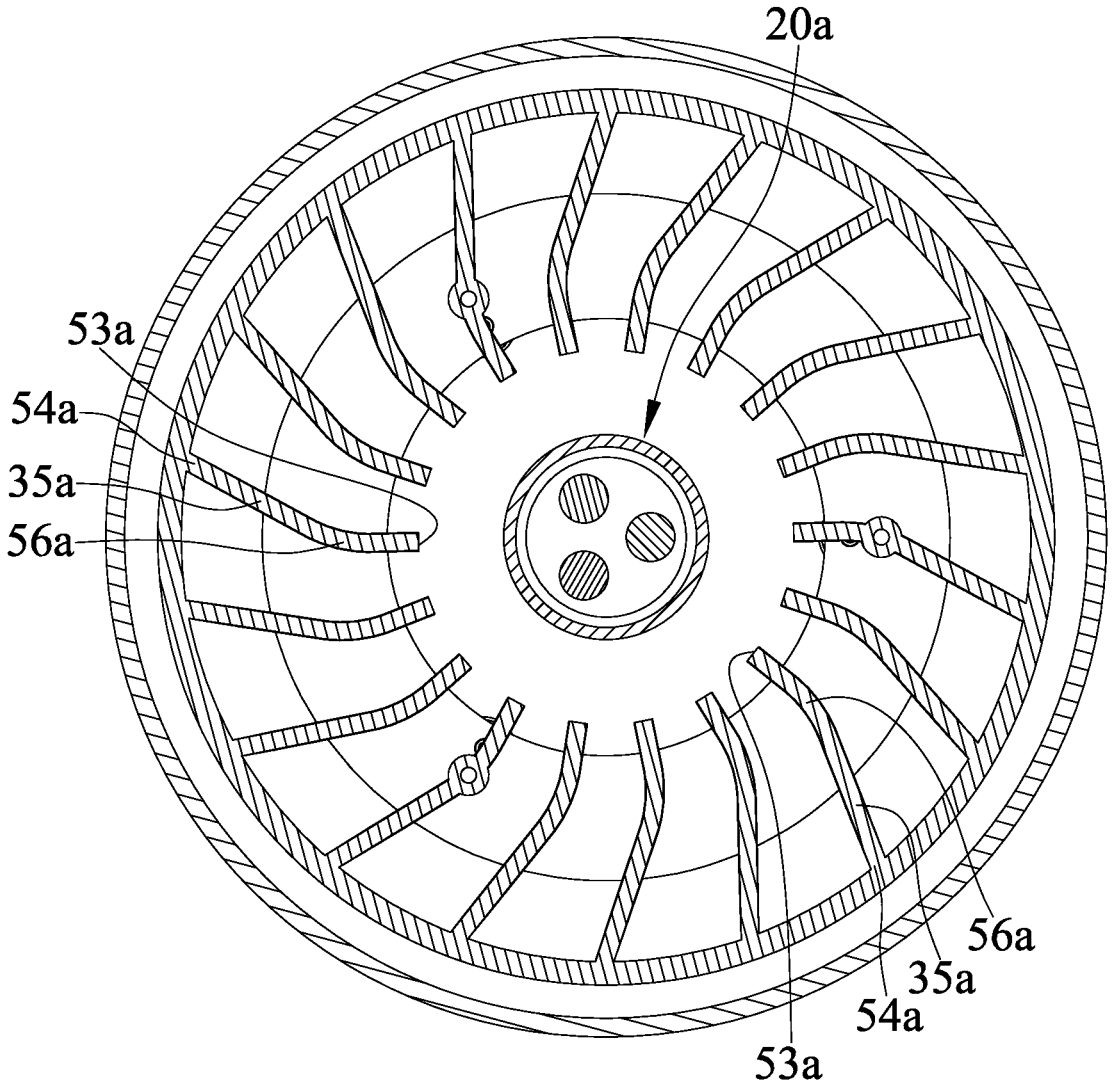
FIG. 6 is a cross-sectional view of a combustion device with heat dissipating design in accordance with a second embodiment of the present invention.

FIG. 6 shows a combustion device with heat dissipating design in accordance with a second embodiment of the present invention, and the same numbers are used to correlate similar components of the first embodiment, but bearing a letter a. The second embodiment includes a burner apparatus 20*a* the same as the burner apparatus 20. The second embodiment is similar to the first embodiment except a plurality of flow guiding blades 35*a*. Two opposite lateral sides of each of the plurality of flow guiding blades 35*a* extend radially in a bended line such that each of the plurality of flow guiding blades 35*a* has a bend section 56*a* adjacent to a first end 53*a* thereof.

Figure 7:
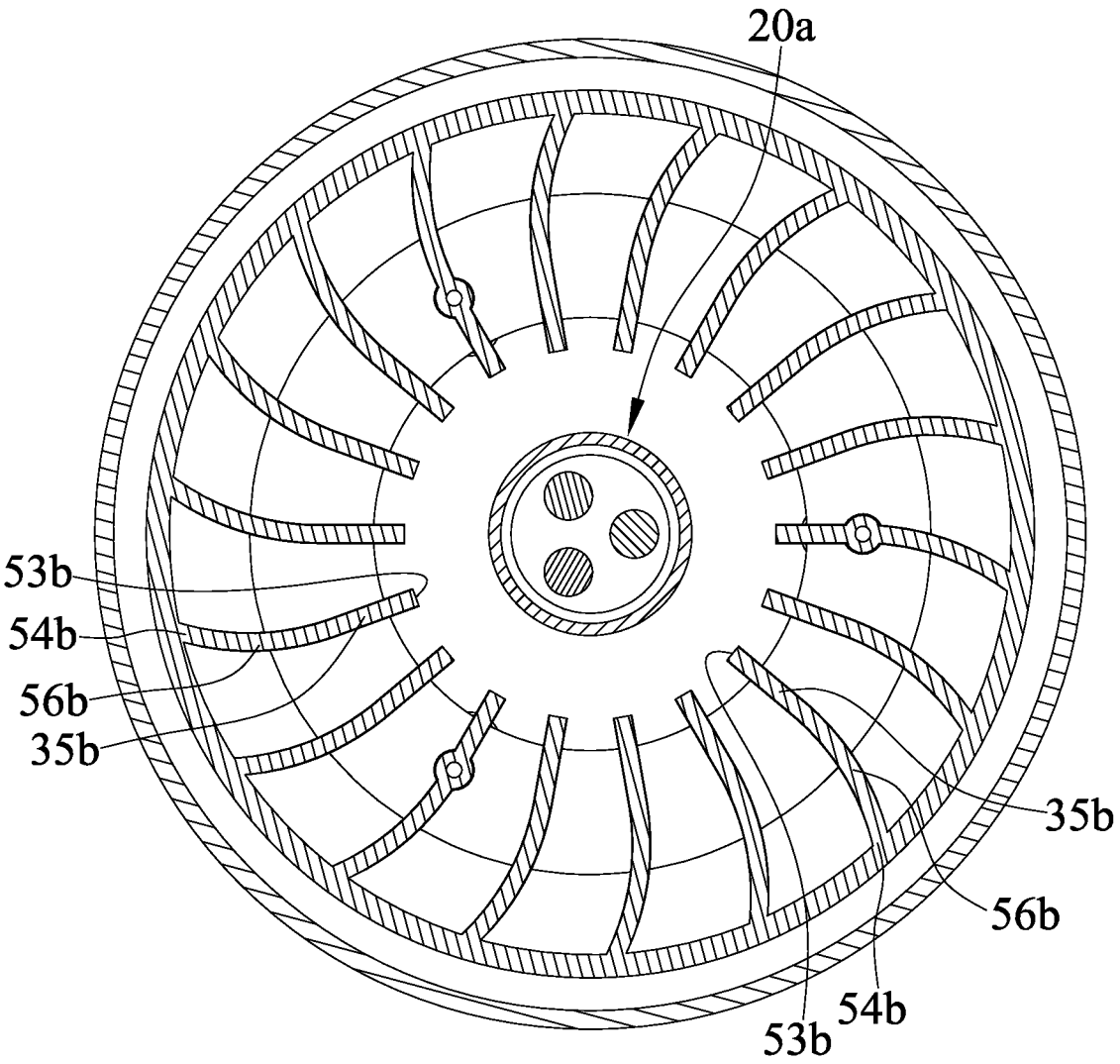
FIG. 7 is a cross-sectional view of a combustion device with heat dissipating design in accordance with a third embodiment of the present invention.

FIG. 7 show a combustion device with heat dissipating design in accordance with a third embodiment of the present invention, and the same numbers are used to correlate similar components of the first embodiment, but bearing a letter b. The third embodiment includes a burner apparatus 20*b* the same as the burner apparatus 20. The third embodiment is similar to the first embodiment except a plurality of flow guiding blades 35*b*. Two opposite lateral sides of each of the plurality of flow guiding blades 35*b* extend radially in a bended line such that each of the plurality of flow guiding blades 35*b* has a bend section 56*b* adjacent to the second end 54*b* thereof.

In view of the forgoing, the combustion device 10 can be normally used and maintains flame visibility even in a windy outdoor environment. As set forth, the flow guiding blades 35 can guide and restrict the flow direction of the cooling air, the upward air flow is offset or weakened by the recirculation formed by the circulation of the side wind, and the influence of the side wind on the combustion device 10 can be greatly reduced, so that the high temperature is not directly contacted with the outer cover to reduce the risk of high temperature accumulation. Further, when the combustion device 10 is moved, a user can directly take the cover 40, and the flow guiding apparatus 50 and the plurality of feet 55 in the embodiment prevents parts of the combustion device 10 from being left even if the user directly grasps the outer cover 40. Further, the first through hole 34 drains the overfilled fuel to minimize the fuel overfilled risks.

The foregoing is merely illustrative of the principles of this invention and various modifications can be made by those skilled in the art without departing from the scope and spirit of the invention.

What is claimed is:

1. A combustion device with heat dissipating design comprising:

a burner apparatus including a fuel reservoir, wherein the fuel reservoir has a top defining an opening;

a shield apparatus defining a space and the burner apparatus is disposed within the space, wherein the shield apparatus has a bottom and the opening is at a first height in a vertical direction from the bottom, wherein the shield apparatus defines a first through hole extending therethrough and communicating the space and the outside of the shield apparatus and the first through hole is at a second height in the vertical direction from the bottom, and wherein the second height is less than the first height, wherein the shield apparatus includes a cover, which is hollow and includes a side wall extending in the vertical direction, and the shield apparatus includes a bottom wall, wherein the space is defined by the cover, and wherein the first through hole extends through the bottom wall; and a flow guiding apparatus disposed within the space, wherein the flow guiding apparatus includes a seat and the bottom wall bears the seat, wherein the seat defines a second through hole extending therethrough and corresponding with the first through hole, and wherein the plurality of flow guiding blades is integrated with the seat.

2. The combustion device as claimed in claim 1, wherein the shield apparatus includes a plurality of flow guiding blades evenly disposed around the burner apparatus and extending radially, and wherein the plurality of flow guiding blades are disposed at a height in the vertical direction between the opening and the first through hole.

3. The combustion device as claimed in claim 1, wherein the cover allows light to pass through.

4. The combustion device as claimed in claim 3, wherein the cover is made of glass.

5. The combustion device as claimed in claim 1, wherein the plurality of flow guiding blades and the seat are made in one piece.

6. The combustion device as claimed in claim 1, wherein the flow guiding apparatus includes at least one foot, and wherein the at least one foot has a first end connected with bottom wall and disposed outside the cover and a second end configured to stand on a surface on which the combustion device is placed and forming the bottom of the shield apparatus.

7. The combustion device as claimed in claim 1, wherein the plurality of flow guiding blades has a bottom side connected with the seat, a top side opposite the bottom side, and two opposite lateral sides extending from the top side to the bottom side, and wherein the top sides of the plurality of flow guiding blades bear the fuel reservoir.

8. The combustion device as claimed in claim 7, wherein each of the plurality of flow guiding blades extends radially from a first end to a second end, wherein the top surface of each of the plurality of flow guiding blades forms a slope adjacent to the first end, and wherein the burner apparatus is disposed adjacent to the first ends of the plurality of flow guiding blades and the fuel reservoir is disposed above the slopes of the plurality of flow guiding blades.

9. The combustion device as claimed in claim 8, wherein the two opposite lateral sides of each of the plurality of flow guiding blades extend radially in a straight line.

10. The combustion device as claimed in claim 8, wherein the two opposite lateral sides of each of the plurality of flow guiding blades extend radially in a bended line such that each of the plurality of flow guiding blades has a bend section adjacent to the first end thereof.

11. The combustion device as claimed in claim 8, wherein the two opposite lateral sides of each of the plurality of flow guiding blades extend radially in a bended line such that each of the plurality of flow guiding blades has a bend section adjacent to the second end thereof.

12. The combustion device as claimed in claim 1, wherein the burner apparatus includes a cap disposed above the fuel reservoir, wherein the cap has at least one hole extending therethrough and communicating an accommodation portion of the fuel reservoir, wherein the cap engages and holds at least one wick in the at least one hole, and wherein the at least one wick has one end protruding above the cap and another end protruding below the cap and received by the accommodation portion.

13. The combustion device as claimed in claim 12, wherein the cap is in a form of a shallow container with a raised rim and has a bottom inserted through the opening and received by the accommodation portion.

14. The combustion device as claimed in claim 6, wherein the plurality of flow guiding blades has a bottom side connected with the seat, a top side opposite the bottom side, and two opposite lateral sides extending from the top side to the bottom side, and wherein the top sides of the plurality of flow guiding blades bear the fuel reservoir.

15. The combustion device as claimed in claim 14, wherein each of the plurality of flow guiding blades extends in a radially from a first end to a second end, wherein the top surface of each of the plurality of flow guiding blades forms a slope adjacent to the first end, and wherein the burner apparatus is disposed adjacent to the first ends of the plurality of flow guiding blades and the fuel reservoir is disposed above the slopes of the plurality of flow guiding blades.

16. The combustion device as claimed in claim 15, wherein the burner apparatus includes a cap disposed above the fuel reservoir, wherein the cap has at least one hole extending therethrough and communicating an accommodation portion of the fuel reservoir, wherein the cap engages and holds at least one wick in the at least one hole, and wherein the at least one wick has one end protruding above the cap and another end protruding below the cap and received by the accommodation portion.

17. The combustion device as claimed in claim 16, wherein the cap is in a form of a shallow container with a raised rim and has a bottom inserted through the opening and received by the accommodation portion.

18. The combustion device as claimed in claim 17, wherein the cover allows light to pass through.

* * * * *